US005172708A

United States Patent [19]

Drewett et al.

[11] Patent Number: 5,172,708

[45] Date of Patent: Dec. 22, 1992

[54] SMOKING ARTICLES

[76] Inventors: Christopher G. Drewett, River View, Mead Lane, Saltford, Bristol, United Kingdom; Brian C. Chard, 12 Ilchester Road, Bedminster Down, Bristol, United Kingdom, BS13 7JA; David Herron, 52 Hampton Park, Redland, Bristol, United Kingdom, BS6 6LJ; Colin D. Luton, 6 Heath Ridge, Long Ashton, Bristol, United Kingdom, BS18 9EW

[21] Appl. No.: 839,288

[22] Filed: Feb. 26, 1992

Related U.S. Application Data

[63] Continuation of Ser. No. 517,808, May 2, 1990, abandoned.

[30] Foreign Application Priority Data

May 26, 1989 [GB] United Kingdom ..... 8912238

[51] Int. Cl.[5] ..... A24D 1/02

[52] U.S. Cl. ..... 131/365; 131/336

[58] Field of Search ..... 131/365, 336

[56] References Cited

U.S. PATENT DOCUMENTS

| | | | |
|---|---|---|---|
| 3,395,714 | 8/1968 | Kahane . | |
| 3,633,589 | 1/1972 | Kahane . | |
| 3,744,496 | 7/1973 | McCarty et al. . | |
| 4,450,847 | 5/1984 | Owens . | |
| 4,505,282 | 3/1985 | Cogbill et al. | 131/365 |
| 4,585,016 | 4/1986 | Grollimund | 131/365 |
| 4,679,575 | 7/1987 | Yamaguchi et al. | 131/365 |
| 4,878,507 | 11/1989 | Case et al. . | |
| 4,911,184 | 3/1990 | Case et al. . | |
| 4,942,889 | 7/1990 | Grollimund | 131/358 |
| 4,964,427 | 10/1990 | Case et al. | 131/365 |
| 4,984,589 | 1/1991 | Riedesser . | |

FOREIGN PATENT DOCUMENTS

| | | |
|---|---|---|
| 143834 | 12/1981 | Denmark . |
| 0085494 | 8/1983 | European Pat. Off. . |
| 0133575 | 2/1985 | European Pat. Off. . |
| 0375844 | 7/1990 | European Pat. Off. . |
| 2139869 | 11/1984 | United Kingdom . |

*Primary Examiner*—V. Millin
*Assistant Examiner*—Lynne A. Reichard
*Attorney, Agent, or Firm*—Larson & Taylor

[57] ABSTRACT

There is disclosed a wrapper for a smoking article, the wrapper comprising a single paper sheet. The sheet is formed from at least two webs. The webs are combined whilst at least one web is still in its wet stage of production prior to drying. Different stocks can be used to make the webs so as to impart different qualities.

18 Claims, No Drawings

SMOKING ARTICLES

This application is a continuation of application Ser. No. 07/517,808 filed May 2, 1990 now abandoned.

This invention concerns smoking articles such cigarettes which normally comprising fibres of organic origin mixed with inorganic fillers and sometimes containing amounts of soluble chemical additives, binding agents and processing aids.

In the case of a cigarette a conventional wrapper would be predominantly comprised of wood and/or textile fibres mixed with inorganic filler such as calcium carbonate. These materials may be subject to a refining process and mixed in various proportions such that the wrapper properties can be widely varied to confer on the cigarette different characteristics such as smoulder rates, air permeability, ash quality, appearance and taste.

Cigarette paper technology has been developed sufficiently to establish relationships between paper parameters such as filler/fibre ratios and properties such as inherent permeability and opacity. These relationships are well known, as indeed are many of the relationships between paper properties and the performance of cigarettes constructed with these papers.

It is recognised that cigarette papers constructed in the conventional way are not homogeneous mixtures of fillers and fibre throughout their cross section. The distribution of the filler tends to change from one side to the other due to the nature of the wet draining process and filtration effect of the fibre. Hence conventional papers have normally a degree of asymmetrical fibre/-filler mix which has a moderate but important effect on their performance especially in relation to ash formation.

By separately constructing papers with quite different properties, using for example pulps of different botanical origin and abnormally high and abnormally low filler contents, the product of their combination as a multi or double wrapper behaves quite differently from a single substantially homogeneous mix of the same components such as is achieved with conventional cigarette paper manufacture.

It has previously been proposed to use two substantially different wrappers on cigarette smoking articles.

U.S. Pat. No. 3395714 describes the use of two thin sheets to form a composite wrapper wherein the outer sheet is a conventional cigarette paper and the inner sheet in contact with the tobacco is a heat insulating plastic film with a melting point below 440° C. The specification also proposes manufacturing as two sheets or as a composite with two sheets glued together or by depositing the plastic film as a solution upon the sheet of cigarette paper. This patent proposes benefits for these systems which benefits include: changes in the low temperature distillation zone affecting smoke taste, reduced tobacco consumption between puffs and reduced emission of sidestream smoke.

U.S. Pat. No. 3633589 proposes a composite wrapper composed of two thin sheets both consisting of vegetable fibre stock so as to provide the benefits claimed for U.S. 3395714 without the disadvantages of plastic films.

U.S. Pat. No. 3633589 provides no teaching as to the method by which the two thin sheets are linked but indicates that the composite wrapper is constructed out of independently manufactured papers described as conventional cigarette paper outer sheet and a calendered inner sheet which is practically impervious to air.

The present invention seeks to utilise the advantages of a multiple layer sheet whilst at the same time overcoming the practical difficulties of using double or multi sheet wrappers. Thus it is desired to have the benefit of combining the properties of different paper wrappers without the manufacturing difficulties associated with either laminating sheets in an off-line process or attempting to manufacture cigarettes with two paper wrappers run simultaneously on the cigarette making machine. Furthermore, it is desired to avoid the disadvantages of laminating adhesives.

According to one aspect of the present invention there is provided a wrapper for smoking articles, which wrapper comprises a single paper sheet which is formed from two or more discrete webs, which webs are combined while at least one of the webs is still in its wet stage of formation prior to drying.

Preferably the webs are formed from different stock. (Stock being the ingredients of the headbox or reservoir).

Conveniently, said two or more webs are combined when all of the webs are in the wet stage of formation prior to drying.

In a preferred embodiment the wrapper is of low air permeability and preferably said permeability is 10 Coresta or less. In other preferred embodiments two partially formed webs are combined and one web is a substantially unfilled web having a low basis weight. Conveniently said weight is 20 $gm^{-2}$ or less and said one web prevents or substantially reduces staining or said one web contains activated carbon.

Further preferred features are that the other web is a filled web conferring a conventional appearance on the wrapper, for example the opacity of the wrapper is 60% or more. It may be that the filler of said other web comprises predetermined amounts of calcium carbonate (up to 50% by weight) or the filler of said other web comprises predetermined amounts of selected fillers, e.g. $Mg(OH)_2$, $Al_2O_3$, LiOH and high surface area $CaCO_3$.

Although it is preferable that the total basis weight of the wrapper is less than 50 $gm^{-2}$ but in other arrangements the total basis weight of the wrapper is less than 35 $gm^{-2}$.

In certain preferred arrangements one or more of the webs may contain a burn retardant such as ammonium phosphate or a burn enhancer such as a soluble salt of a group I or group II metal, maybe up to 10% by weight.

According to a second aspect of the invention there is provided a smoking article comprising a rod of smoking material and a wrapper having any of the above features.

The term "duplex" as used in this specification is intended to cover sheets which comprise two or more webs wherein at least one web is in the partially formed wet stage prior to drying when the two or more webs are combined or superposed. Thus the adhesion between the two layers is achieved by the fibre bonding inherent in the papermaking process. Furthermore, this method of formation introduces an interaction between the two or more layers, which interaction can have a surprising effect on the air permeability of the final duplex sheet. Clearly the component webs may be formed from different stocks arising from separate headboxes or reservoirs on a multi-wire machine, or at least one web may be produced off-line and re-introduced as a finished sheet to the wet stage of a second paper making machine. In either method of manufacture the objective is to use the fibre structure to provide an integral sheet formed of two or more layers which is capable of being used as a wrapper for smoking articles.

Whereas conventional papers are also asymmetric in that the proportion of fibre to filler may vary from one side of the sheet to the other, it is possible with duplex papers to provide a radical change and alteration in properties from one side to the other rather than the gradual change of properties associated with single wire sheets of conventional form.

Thus it is possible using duplex papers to provide a paper sheet having differing characteristics on one side of the paper from those on the other.

Compared with the use of laminated material or the use of two or more different sheets wrapped together to form a wrapper, the difficulties mentioned above with laminating techniques and running two or more wrappers on a cigarette making machine are of course avoided. Additionally, by utilising a multiple wire machine supplied with different stock to each wire to form a single sheet of such different characteristics across its section, there is observed a synergism which affects the properties of the duplex web not previously discovered or alluded to in the prior art. We have discovered that air permeability due to the inherent porous structure of the paper is not a simple function of the flow through the two component parts but can be very much reduced due to the integrity of the surfaces. The same does not occur when two separate wrappers are brought together after the wet stage following completion of the paper making process.

Table 1 shows air permeability data obtained with the Gurley system for duplex papers and the component parts. In these and subsequent tests the component parts, i.e. inner and top layers or webs, were acquired at the paper making machine by sampling from each web without the two becoming joined together. The sample was then finish treated as a normal sheet.

The Gurley system of air permeability measurement is suitable for assessment of cigarette papers which have low permeabilities relative to usual commercial standards. The method involves measurement of the time taken to displace a fixed volume of air through a defined area of paper under the constant load of a weighted falling piston. The apparatus is sold commercially by W & L E Gurley, Fulton Street, Troy, New York 12181. The test is set out in ISO 3687-1976. In the table, adjacent columns do not correspond.

TABLE 1

| | Air Permeability Data (Gurley seconds) | | | |
|---|---|---|---|---|
| Sample No | Duplex | Top Layer | Inner Layer | Double Wrap |
| 3 | 30 000 | 11 | 4.5 | 13 |
| | 23 375 | 10 | 5 | 14 |
| | | 10 | 6 | 17 |
| | | 11 | 10 | |

TABLE 1-continued

| | Air Permeability Data (Gurley seconds) | | | |
|---|---|---|---|---|
| Sample No | Duplex | Top Layer | Inner Layer | Double Wrap |
| | | 8 | | |
| | | 9 | | |
| 6 | 760 000 | 65 | 670 | 5500 |
| | 725075 | 57 | 550 | 6950 |
| | | 64 | 830 | 4950 |
| | | 52 | 3140 | |
| | | 68 | | |
| | | 42 | | |

The interaction between the two surfaces has also been found to secure even lower levels of air permeability than would be achieved with a double wrap comprising each of the components of the duplex paper. Clearly, this is a benefit for formulations where low air permeability is an objective as in the case of cigarettes where a low sidestream smoke may be required.

Additionally it has been observed that the limitations normally imposed on the manufacture of individual webs by poor tensile strength, low basis weight and poor appearance, no longer apply because the duplex paper exhibits properties that are determined by the composite system and these are generally found to be superior to any individual component. As a result it becomes possible to consider duplex characteristics which would not be achievable as a double wrap. Table 2 provides data on tensile strength, basis weight and opacity of duplex papers and its component parts. Opacity being measured on a standard EEL machine (according to BS 4432), on which standard cigarette papers have opacities of 60% or more.

TABLE 2

| | Tensile Strength, Basis Weight and Opacity Data | | | | | | | | |
|---|---|---|---|---|---|---|---|---|---|
| Sample | Tensile Strength g mm$^{-1}$ | | | Basis Weight, g m$^{-2}$ | | | Opacity % | | |
| No | Dup | Top | Inner | Dup | Top | Inner | Dup | Top | Inner |
| 1 | 195 | 95 | 62 | 32.6 | 19.1 | 13.5 | 71.6 | 60.4 | 20.2 |
| 2 | 211 | 31 | 79 | 37.4 | 24.1 | 13.3 | 71.0 | 68.2 | 19.4 |
| 5 | 207 | 66 | 69 | 38.3 | 23.7 | 14.6 | 78.4 | 66.2 | 22.0 |
| 7 | 207 | 14 | 86 | 36.3 | 18.9 | 17.4 | 69.4 | 62.2 | 18.8 |
| 9 | 311 | 42 | 114 | 47.7 | 29.6 | 18.1 | 77.8 | 72.4 | 21.0 |

In one application the duplex sheet has been formed from two stocks, one of which provides the characteristics of highly impermeable paper and the other of which provides some of the characteristics of conventional cigarette paper, particularly in relation to appearance.

One particular embodiment of the present invention provides a duplex paper for use in the manufacture of cigarettes, which paper has been formed from two or more stocks one of which has a composition that provides the characteristics of a highly impermeable paper and the other of which is stock suited to the manufacture of chalk filled cigarette papers.

There are many uses for wrappers of smoking articles having unusual non-homogeneous cross-sectional characteristics, but one of particular interest is for use with the product of our co-pending British application No 8901579.6 of 25 January 1989, which forms the basis for European application No 90300750.8.

In application 8901579.6, a cigarette paper is required which will produce a self-extinguishing smoking article. This is, of course, contrary to the normal requirement of traditional cigarettes which are expected to smoulder readily and maintain combustion between puffs. The purpose of this construction is to achieve low and even negligible sidestream smoke deliveries between puffs.

weight are feasible with this system whilst still maintaining acceptable appearance, strength etc.

TABLE 3

| Sample | Data for 32 $gm^{-2}$ Duplex Paper | | | | | | | | | |
|---|---|---|---|---|---|---|---|---|---|---|
| | Basis Weight $gm^{-2}$ | | | $CaCO_3$ | Air Perm Gurley(s) | | | Opacity % | | |
| No | Dup | Top | Inner | % Top | Dup | Top | Inner | Dup | Top | Inner |
| 4 | 32.0 | 18.2 | 14.8 | 27.9 | 13900 | 1 | 640 | 68 | 61 | 18 |
| | 31.3 | 18.2 | 15.3 | | 93000 | 1 | 1470 | 68 | 61 | 19 |
| | 30.8 | 18.0 | 14.0 | | 21050 | 1 | | 67 | 60 | 18 |
| | | | | | 6650 | 2 | | 67 | 61 | 20 |
| | | | | | | | | 68 | 62 | 18 |

A paper can be made which will readily self-extinguish the cigarette but such papers are normally of the Papirossi type having a high fibre density and low opacity characteristic of impermeable paper sheets.

Such highly impermeable papers are unattractive for use on cigarettes since, although they may achieve the objectives set out in our co-pending application, they do not have an appearance which is acceptable to the smoker and, furthermore, readily exhibit uneven burning and excessive charline formation and show staining during smoking.

To overcome this disadvantage the highly impermeable, low opacity paper could be overwrapped with conventional cigarette paper. However, the disadvantage of this proposal is that the overwrapping must be done on the cigarette making machine or the two wraps must be laminated thus suffering from the disadvantages outlined above.

Double wrapping has been employed commercially in the U.S.A. by Philip Morris on the Virginia Superslims brand, but in this construction it results in a total paper basis weight of 70 $gm^{-2}$ compared to conventional papers at about 25 $gm^{-2}$. Thus to achieve more conventional weights of paper the two components of the double wrap must be exceptionally low basis weight and may be low in strength which would therefore be difficult and in some cases impossible to make or use commercially as a single sheet.

In one embodiment of the present invention the problem can be solved by forming a duplex paper in which a stock for highly impermeable low opacity paper is used to produce a partially formed web which is combined with a partially formed web made from stock of a more conventional cigarette paper, the two partially formed webs being combined before drying to form a duplex sheet having differing characteristics from one side of the sheet to the other.

By using such duplex papers in making cigarettes, the conventional appearance can be placed on the outside of the cigarette with a lower opacity reverse side against the tobacco, thus providing the characteristics required for the product without detracting from the appearance, and without staining etc.

Furthermore, as an integral duplex sheet the interaction between the two components increases tensile strength and creates an opportunity to manufacture low basis weight sheets with properties that, as single sheets, would be unacceptable for manufacturing reasons. Paper manufacturing developments have produced a duplex cigarette paper with a weight of 32 $gm^{-2}$; this being comprised of a dense low permeability, low opacity layer of 15 $gm^{-2}$ and a higher permeability, higher opacity chalk-filled layer. The data for this paper are given in table 3. Conventional cigarette paper making methods will not produce a paper with the same properties as this duplex sheet. Further reductions in basis Additionally, the experience of manufacturing duplex papers has shown that it has reduced thickness compared with the sum of the thicknesses of the two layers from which it is formed, thus further emphasising the integrity of the forming process. Table 4 shows thickness data for a range of duplex formulations.

TABLE 4

| Thickness Data for Duplex Paper and Component Parts (micrometers) | | | |
|---|---|---|---|
| Sample No | Duplex | Top | Inner |
| 1 | 49 | 38 | 22 |
| 3 | 57 | 49 | 25 |
| 8 | 65 | 46 | 34 |

It will be appreciated that there are many other applications of duplex papers in cigarette making. Unusual characteristics required for the wrapper may be achieved without detriment to appearance or handling in cigarette manufacture. These unusual characteristics can be provided by the inner face of the duplex wrapper whilst maintaining the desired appearance with the outer surface.

The paper characteristics may be designed to modify taste, burn rate, sidestream smoke delivery, ignition proclivity or even to achieve changes in appearance.

The construction can provide opportunities to include paper additives or fillers with beneficial effect such as improvements to the ideas contained in the patent literature. For example, the outer surface may include a disproportionately high level of calcium carbonate of normal or enhanced specific surface area such as is suggested in GB Patent 2191930A while the inner surface provides control of air permeability, strength and staining, and where this construction has as its objective reductions in sidestream smoke.

Further examples are achieved by the replacement of calcium carbonate in the outer surface with an alternative filler chosen from a list of those which demonstrate sidestream reducing properties when used as single sheets, conferring on them the benefits of duplex manufacture that is strength, control of air permeability, resistance to staining and enhanced reduction of sidestream smoke. Suggested fillers are: magnesium hydroxide as detailed in U.S. 4231377 and GB 2118986B; aluminium hydroxide, calcium hydroxide or lithium hydroxide (U.S. 4721120); gamma alumina (US 4108151) or those contained in GB 2191930, although this list is by no means exhaustive.

Other wrapper modifications have been suggested in the literature to improve taste and reduce smoke deliveries as for example in U.S. 4225636 and U.S. 4505282 where a carbon inner liner is proposed. A similar objective could be achieved with a duplex wrapper where the external surface provides conventional appearance and the internal surface contains a suitable proportion of activated carbon. The resulting wrapper might even be designed to provide a suitable combustion source to meet the requirements of one of the embodiments described in co-pending UK patent application No 8901579.6.

The system might also be designed with a low absorbing inner surface as a solution to yellow spotting during storage of cigarettes without a need for double wraps which has been proposed by at least one commercial paper manufacturer.

A duplex wrapper for cigars may also be devised as a means of replacing the binder and overwrap currently used in the manufacture of the majority of cigars. The advantage of a duplex construction is to provide scope in the formulation of the two surfaces not achievable with conventional paper made wrappers in order to enable the desired appearance, burning properties and taste to be achieved.

It will of course be appreciated that the duplex papers discussed in this specification are formed from stocks which are made up in accordance with recognised paper making techniques and which can contain, either separately or as chosen mixtures, textile fibres (such as flax or hemp), hard wood fibres, soft wood fibres and other fibres (such as esparto).

The invention will now be illustrated by way of some examples.

EXAMPLE 1

This example refers to our co-pending British patent application No. 8901579.6 for which a duplex cigarette paper has been developed to provide control over free smoulder and achieve a reduction in sidestream smoke emissions. (A definition for sidestream smoke is given in the 8901579.6 application).

Papers were initially developed to provide rapid self-extinguishing and later modified with burn promoters for reasons explained in the co-pending application.

The requirement for low porosity, which affects cigarette coal shape and propagation was dictated by the need to trap condensable vapour phase which normally emerges from behind the coal as sidestream "smoke" and also to reduce the consumption of tobacco between puffs, thereby reducing the production of sidestream emissions. Initially this need was met with a double wrap in which the inner wrap provided low porosity and high density but was translucent and burnt unevenly. The outer wrap was normal cigarette paper and provided good appearance and even burning.

The idea of a lightweight duplex paper was pursued as a solution to the problems of manufacturing double wrapped cigarettes, a desire for a low weight of paper and a dislike of and lack of success with adhesive laminations and coatings.

The duplex paper used predominantly with examples quoted in co-pending application No 8901579.6 had the following specification:

TABLE 5

| Duplex Paper Specification used for Co-pending Application 8901579.6 | Basis Weight, $gm^{-2}$ | Fibre Type |
|---|---|---|
| Duplex | 37 | 40% Pine 20% Birch |
| Top | 25 | 40% Eucalyptus |
| Inner | 12 | 70% Pine 30% Birch |
| Calcium Carbonate, % (Top Layer) | 22 | |

TABLE 5-continued

| Duplex Paper Specification used for Co-pending Application 8901579.6 | Basis Weight, $gm^{-2}$ | Fibre Type |
|---|---|---|
| Air permeability, Gurley(s) | 385000 | |
| Sample Code | 0589987 | |

Cigarettes were made with expanded tobacco blend to a density of 143 $Kgm^{-3}$ and incorporating the fuel element described in the co-pending application. These were compared in smoking test with commercial cigarettes to establish mainstream and sidestream total particulate matter (TPM) deliveries. The results in Table 6 were obtained.

TABLE 6

| Type | | No Puffs | Mainstream TPM $mg\ cig^{-1}$ | Sidestream TPM $mg\ min^{-1}$ | Oven Dry Density $Kgm^{-3}$ |
|---|---|---|---|---|---|
| Vantage | x | 6.3 | 11.4 | 1.3 | 142 |
| Excel | SD | 0.5 | 1.9 | 0.09 | |
| (RJR-USA) | n | 30 | 10 | 10 | |
| Embassy | x | 9.0 | 9.4 | 2.32 | 234 |
| Mild | SD | 0.4 | 0.9 | 0.12 | |
| (ITL-UK) | n | 24 | 7 | 8 | |
| Test | x | 13.8 | 6.6 | 0.55 | 143 |
| Sample | SD | 1.0 | 0.8 | 0.05 | |
| | n | 29 | 9 | 9 | |

These results show the substantial reduction in rate of sidestream production for the test cigarette compared with a commercial low sidestream product (Vantage) available from R J Reynolds of U.S.A. and a typical low tar UK brand. The results also show the significantly increased puff number obtained from an equal or lower density and therefore lower weight of tobacco. (These cigarettes had similar circumferences and tobacco length).

Additionally the appearance of the cigarette paper was consistent with commercial brands and there was no appreciable yellow spotting prior to smoking or staining during smoking.

Ash characteristics were improved compared with ordinary low air permeability papers and further improvements were observed with the use of ash conditioning additives, for example potassium citrate applied at levels up to 7% of paper weight.

EXAMPLE 2

An early attempt at manufacturing a duplex cigarette paper produced a relatively high permeability chalk "free" inner layer and a lower permeability chalk filled top layer. The pulps used were a mixture of eucalyptus and flax. Two samples were produced to achieve different levels of permeability in the chalk filled layer. Paper details are given in Table 7 below, the fibres in both webs of both samples comprising 50% Flax 50% Eucalyptus.

TABLE 7

| Duplex Paper 0189969A and B | 0189969A | 0189969B |
|---|---|---|
| Basis weight, $gm^{-2}$ | | |
| Duplex | 43.6 | 42.3 |
| Top | 24.8 | 25.6 |
| Inner | 17.3 | 17.3 |
| Air Permeability, Coresta Units | | |
| Duplex | 10 | 8 |

TABLE 7-continued

| Duplex Paper 0189969A and B | 0189969A | 0189969B |
|---|---|---|
| Top | 59 | 29 |
| Inner | 94 | 94 |
| Calcium Carbonate, % Top Layer | 34 | 36 |
| Opacity, % (Duplex) | 84.6 | 84.5 |

Coresta permeability is a standard measure used in the tobacco industry for cigarette paper air permeability. The apparatus involves a sample clamp which exposes a 2 $cm^2$ sample to a constant pressure of 1 kilo Pascal and provides a means of measuring the flow rate through the sample. Results are quoted in units of $ml/min/cm^2/K$ Pa.

Cigarette samples were made for mainstream and sidestream smoking tests to a specification which is consistent with some UK low tar commercial cigarettes, i.e. 59 mm tobacco rod, 25 mm filter, 24.9 mm circumference, 210 kg $m^{-3}$ oven dry tobacco density, and 45% tip ventilation.

In smoking tests these cigarettes were found to free smoulder without the assistance of a puffing source. They produced about 8 mg of total particulate matter (TPM) from 10 puffs with a standard smoking regime using a 35 ml puff volume over 2 seconds, repeated every minute.

Sidestream smoke deliveries were measured as TPM collected on a filter pad and as an aerosol density index according to methods described in co-pending patent application 8901579.6.

TABLE 8

| | Conventional Low Tar Cigarettes | 0189969A | 0189969B |
|---|---|---|---|
| Mainstream | | | |
| TPM, mg $cig^{-1}$ | 9.4 | 7.8 | 9.2 |
| Puffs | 9.0 | 10.3 | 10.1 |
| Carbon Monoxide, mg $cig^{-1}$ | | 14.4 | 18.0 |
| Sidestream | | | |
| TPM, mg $min^{-1}$ | 2.32 | 1.3 | 1.4 |
| Visible Sidestream Index, (average value) | 5.7 | 2.7 | 2.8 |

Reductions in the sidestream smoke in excess of 40% were obtained with this construction whilst maintaining a paper of good appearance and capable of sustaining free smoulder without the use of burn enhancing additives.

EXAMPLE 3

In this example we have demonstrated a means of achieving an alternative wrapper for a free smouldering low sidestream cigarette which improves upon the reductions in sidestream smoke delivery obtained in example 2. In summary, we have taken the knowledge gained in the development of papers and product specifications for our co-pending patent 8901579.6 and with the use of burn promoters (already well known to the industry) applied to the paper we have been able to produce a free smouldering (self sustaining coal) low sidestream cigarette with typical UK cigarette dimensions, appearance and mainstream smoke deliveries.

The duplex paper samples were selected on the basis of previous test data and were treated with a solution of potassium citrate to achieve the levels shown in Table 9 below. Treatment was carried out by surface contact between the top side of the duplex paper and the liquid reservoir, followed by subsequent drying and rewinding. The process could be replicated through the usual on-line cigarette paper machine soluble additive application facilities such as a size press, and other soluble additives selected from the range of cigarette paper additives known in the prior art would be suitable.

The additive level was checked after application and cigarettes were made with each of the treated papers for mainstream and sidestream smoke delivery measurements. Details of the cigarette papers are given in Table 9.

TABLE 9

| Cigarette Paper Details | 0389978B | 0989923 |
|---|---|---|
| Basis weight, $gm^{-2}$ | | |
| Duplex | 37.1 | 37.8 |
| Top Layer | 25.4 | 26.4 |
| Inner Layer | 14.5 | 11.3 |
| Fibres | | |
| Top Layer (Pine/Birch/Eucalyptus) | 43/17/40% | 40/20/40% |
| Inner Layer (Pine/Birch) | 70/30% | 70/30% |
| Air Permeability, Gurley(s) | | |
| Duplex | 240,000 | 27,600 |
| Top Layer | 4 | 10 |
| Inner Layer | 1480 | 6 |
| Calcium Carbonate, % Top Layer | 23.2 | 33.5 |
| Opacity, % Duplex | 74 | 80 |
| Tensile, g $mm^{-1}$ Duplex | — | 168 |
| % Potassium Citrate | 6.9 | 5.3 |

The cigarette dimensions were typical of UK commercial brands but tobacco density was reduced to 110 kg $m^{-3}$ using cut tobacco expanded by at least 75% of its bulk volume using a commercially available tobacco expansion process. The precise level of expansion or mixture of expanded and non-expanded tobacco is a matter for determination in order to achieve an acceptable balance of cigarette draw resistance, tobacco rod firmness and combustion rate.

The cigarette construction was as follows: 59 mm tobacco rod, 25 mm filter, 24.8 mm circumference, 110 kg $m^{-3}$ oven dry density, 50% tip ventilation, and 100% of highly expanded cut tobacco blend.

Smoking tests were carried out according to standard procedures to assess mainstream deliveries and sidestream measurements were confined to an assessment of the aerosol density using the "visible index" method described in our co-pending application 8901579.6. The following data was obtained:

TABLE 10

| | Conventional Low Tar Cigarettes | 0389978B | 09899923 |
|---|---|---|---|
| Mainstream | | | |
| TPM, mg $cig^{-1}$ | 9.4 | 10.2 | 8.8 |
| Puffs | 9.0 | 7.0 | 6.8 |
| Carbon Monoxide, mg $cig^{-1}$ | — | 13.0 | 11.9 |
| Static burn time, s $mm^{-1}$ | 12 | 11.9 | 10.3 |
| Sidestream | | | |
| Visible Index (average value) | 5.7 | 0.5 | 0.5 |

These results demonstrate very substantial improvements in sidestream reduction compared with the previous example and are achieved with a paper that has good visual and burning characteristics and is substantially free of unsightly staining. Furthermore these products will free smoulder without the need for an additional fuel source and permit substantial reductions in tobacco weight.

We claim:

1. A paper wrapper for smoking articles, which wrapper comprises two or more substantially planar plies formed from discrete webs combined while at least one of the webs is in the wet stage of formation, whereby there is interaction of the fibres between adjoining piles so that the wrapper is in the form of a single sheet, each ply having a basis weight of less than 20 $g/m^2$, the total basis weight of the wrapper being less than 40 $gm^{-2}$.

2. A wrapper as claimed in claim 1 wherein the two or more webs are formed from different stocks.

3. A wrapper as claimed in claim 1 wherein said two or more webs are combined when all of the webs are in the wet stage of formation prior to drying.

4. A wrapper as claimed in claim 1 wherein two partially formed webs are combined.

5. A wrapper as claimed in claim 4 wherein said one web reduces staining during smoking and yellow spotting during storage.

6. A wrapper as claimed in claim 4 wherein said one web contains activated carbon.

7. A wrapper as claimed in claim 1 wherein one web is a substantially filled web and the other web is a filled web conferring a conventional appearance on the wrapper.

8. A wrapper as claimed in claim 7 wherein the opacity of the wrapper is 60% or more.

9. A wrapper as claimed in claim 7 wherein the filler of said other web comprises predetermined amounts of calcium carbonate.

10. A wrapper as claimed in claim 9 wherein the web comprises up to 50% weight of calcium carbonate.

11. A wrapper as claimed in claim 7 wherein the filler of said other web comprises predetermined amounts of selected fillers, e.g. $Mg(OH)_2$, $Al_2O_3$, LiOH and high surface area $CaCO_3$.

12. A wrapper as claimed in claim 1 wherein the total basis weight of the wrapper is less than 35 $gm^{-2}$.

13. A wrapper as claimed in claim 1 wherein one or more of the webs contains a burn modifier.

14. A wrapper as claimed in claim 13 wherein the burn modifier is ammonium phosphate.

15. A wrapper as claimed in claim 13 wherein the burn modifier is less than 10% weight of a soluble salt of a group I or group II metal.

16. A wrapper as claimed in claim 1 wherein the wrapper has an air permeability of 10 coresta or less.

17. A smoking article comprising a rod of smoking material and a wrapper, said wrapper comprising a single paper sheet, said sheet being formed from a plurality of discrete webs, said webs being combined with one of the webs in a wet stage of formation prior to drying whereby there is interaction of the fibres between adjoining plies so that the wrapper is in the form of a single sheet wherein the wrapper permeability is about 10 Coresta and the basis weight is about 43 $gm^{-2}$, the tobacco rod is 59 mm long and has a circumference of 24.9 mm and a tobacco density of 210 $Kgm^{-3}$, and a filter having a 25 mm length and giving 45% ventilation is provided.

18. A smoking article comprising a rod a smoking material and a wrapper, said wrapper comprising a single paper sheet, said sheet being formed from a plurality of discrete webs, said webs being combined with one of the webs in a wet stage of formation prior to drying whereby there is interaction of the fibres between adjoining plies so that the wrapper is in the form of a single sheet wherein the wrapper air permeability is 27600 Gurley seconds or more and the basis weight is about 37 $gm^{-2}$, the tobacco is 100% expanded and the density is 110 $Kgm^{-3}$, the rod is 59 mm long and has a 24.8 mm circumference, a filter having a 25% mm length and giving 50% ventilation is provided and the wrapper also contains up to 10% weight of potassium citrate.

* * * * *